United States Patent [19]

Uchiyama

[11] Patent Number: 5,029,837

[45] Date of Patent: Jul. 9, 1991

[54] SHEET FEEDING APPARATUS

[75] Inventor: Tadamitsu Uchiyama, Osaka, Japan

[73] Assignee: Minolta Camera Kabushiki Kaisha, Osaka, Japan

[21] Appl. No.: 365,966

[22] Filed: Jun. 13, 1989

[30] Foreign Application Priority Data

Jun. 14, 1988 [JP] Japan ..... 63-147694

[51] Int. Cl.[5] ..... B65H 7/12

[52] U.S. Cl. ..... 271/110; 271/122; 271/263; 271/902

[58] Field of Search ..... 271/263, 110, 111, 122, 271/902

[56] References Cited

U.S. PATENT DOCUMENTS 3,937,453 2/1976 Hickey ..... 271/263 X
3,961,786 6/1976 Yonker .
4,491,929 1/1985 Ikoma ..... 271/263
4,813,658 3/1989 Hosking ..... 271/263 X

FOREIGN PATENT DOCUMENTS 50-16974 6/1975 Japan .

*Primary Examiner*—Richard A. Schacher
*Attorney, Agent, or Firm*—Burns, Doane, Swecker & Mathis

[57] ABSTRACT

A sheet feeding apparatus has a stocker unit for storing a stack of sheet materials, a forward sheet feed roller having an operative condition capable of feeding a sheet material in a forward direction from the stocker unit during each cycle of operation of the apparatus, a sheet passageway through which a sheet material is to be fed in the forward direction further away from the stocker unit, a detector assembly for detecting the presence of a single sheet material or the concurrent presence of two or more sheet materials in the sheet passageway, a backward/forward feed roller located in proximity to the forward sheet feed roller and operative to feed a sheet material in a backward direction toward the stocker unit, a control system for actuating the backward/forward feed roller to feed a sheet material in the backward direction toward the stocker unit if the concurrent presence of two or more sheet materials in the sheet passageway is detected by the detector assembly when the forward sheet feed roller is in the operative condition, or the presence of at least one sheet material in the sheet passageway is detected by the detector assembly when the forward sheet feed roller is not in the operative condition.

23 Claims, 6 Drawing Sheets

SHEET FEEDING APPARATUS

FIELD OF THE INVENTION

The present invention relates to a sheet feeding apparatus for feeding sheet materials one after another from a stack of sheet materials to any utilization apparatus such as for example an image duplicating or printing apparatus.

BACKGROUND OF THE INVENTION

An example of a known sheet feeding apparatus is shown in Japanese Patent Publication No. 50-16974. The sheet feeding apparatus therein disclosed is for use in a collating machine and is characterized by a function to preclude an occurrence of double or overlapped feeding of sheet materials.

During each cycle of operation in this prior-art sheet feeding apparatus, the uppermost one of the sheet materials stored in the form of a stack is picked up from the stack by a pickup roll positioned on top of the stack and is fed forwardly away from the stack by means of a forward feed roller positioned posterior to the pickup roll. Below the forward feed roller is provided a backward/forward feed roller which is cooperative with the overlying forward feed roller to drive a sheet material to travel forwardly away from the stack of sheet materials. When the presence of a surplus sheet material which has been improperly fed in addition to a properly fed sheet material is detected, the backward/forward feed roller is rotated in the reverse direction so that the surplus sheet material underlying the properly fed sheet material is to be returned toward the stack of the sheet materials.

In the meantime, it is sometimes experienced in a sheet feeding apparatus that a single sheet material or even two or more sheet materials are left in the apparatus after termination of a cycle of operation. If such a sheet material or materials are allowed to stay in the apparatus before the subsequent cycle of operation is started, there may be jamming of the sheet or materials requiring the operator of the apparatus to remove the jammed sheet material or materials only through recourse to a laborious, time-consuming servicing procedure.

In a sheet feeding apparatus it is for this reason desirable to detect not only the overlapped feeding of sheet materials but also the presence of any sheet material improperly remaining in the apparatus during each cycle of operation and forcibly return the improperly remaining sheet material to or at least toward the stack of sheet materials.

SUMMARY OF THE INVENTION

It is, accordingly, a prime object of the present invention to provide an improved sheet feeding apparatus which is capable of returning an improperly fed sheet material toward the stack of sheet materials not only when the overlapped feeding of sheet materials is detected but also it is detected that a single sheet material or two or more sheet materials are improperly left in the apparatus during each cycle of operation of the apparatus.

In accordance with one outstanding aspect of the present invention, there is provided a sheet feeding apparatus comprising (a) sheet storage means for storing a stack of sheet materials, (b) forward sheet feeding means having an operative condition capable of feeding a sheet material in a forward direction from the sheet storage means during each cycle of operation of the apparatus, (c) sheet transport means forming a passageway through which a sheet material is to be fed in the forward direction further away from the sheet storage means, (d) detecting means for detecting the presence of a single sheet material or the concurrent presence of two or more sheet materials in the passageway, (e) backward sheet feeding means located in proximity to the forward sheet feeding means and operative to feed a sheet material in a backward direction toward the sheet storage means, (f) control means for actuating the backward sheet feeding means to feed a sheet material in the backward direction toward the sheet storage means if (f/1) the concurrent presence of two or more sheet materials in the passageway is detected by the detecting means when the forward sheet feeding means is operating, or (f/2) the presence of at least one sheet material in the passageway is detected by the detecting means when the forward sheet feeding means is not operating.

In accordance with another outstanding aspect of the present invention, there is provided a sheet feeding apparatus comprising (a) sheet storage means for storing a stack of sheet materials, (b) first sheet feeding means means having an operative condition capable of feeding a sheet material in a forward direction away from the sheet storage means during each cycle of operation of the apparatus, c) detecting means operative to detect the presence of a single sheet material properly fed in the forward direction away from the sheet storage means or of a plurality of sheet materials which may be concurrently fed in the forward direction from the sheet storage means and which include a single properly fed sheet material to be further moved away from the sheet storage means by the first sheet feeding means and at least one improperly fed sheet material to be moved in a backward direction toward the sheet storage means, (d) second sheet feeding means means having an operative condition capable of feeding the improperly fed sheet material in the backward direction toward the sheet storage means when the presence of the improperly fed sheet material is detected by the detecting means, and (e) third sheet feeding means operative to further feed the properly fed sheet material in the forward direction away from the sheet storage means, (f) the detecting means being further operative to detect the presence of at least one improperly fed sheet material which has been fed in the forward direction from the sheet storage means by the first sheet feeding means and which has not been further fed away from the sheet storage means by the third sheet feeding means until the first sheet feeding means is de-activated out of the operative condition thereof.

A sheet feeding apparatus thus constructed and arranged in accordance with the second outstanding aspect of the present invention may further comprise a control system which comprises (g/1) signal generating means operative to produce a first signal for activating the first sheet feeding means into the operative condition thereof, and (g/2) means cooperative with the detecting means for producing a second signal indicative of the presence of a single sheet material fed in the forward direction from the sheet storage means or a third signal indicative of the presence of at least one sheet material improperly fed sheet material which has been fed in the forward direction from the sheet storage means concurrently with and in addition to the single sheet material, (g/3) the second sheet feeding means being responsive to the first, second and third signals for feeding the improperly fed sheet material in the backward direction toward the sheet storage means in the concurrent presence of the first and third signals, feeding the single sheet material in the backward direction toward the sheet storage means in the absence of the first signal and concurrent presence of the second signal, and feeding the improperly fed sheet material in the backward direction toward the sheet storage means in the absence of the first signal and concurrent presence of the third signal.

BRIEF DESCRIPTION OF THE DRAWINGS

The features and advantages of a sheet feeding apparatus according to the present invention will be more clearly appreciated from the following description taken in conjunction with the accompanying drawings in which like reference numerals designate similar or corresponding units members and elements and in which.

DESCRIPTION OF THE PREFERRED EMBODIMENTS

Figure 1:
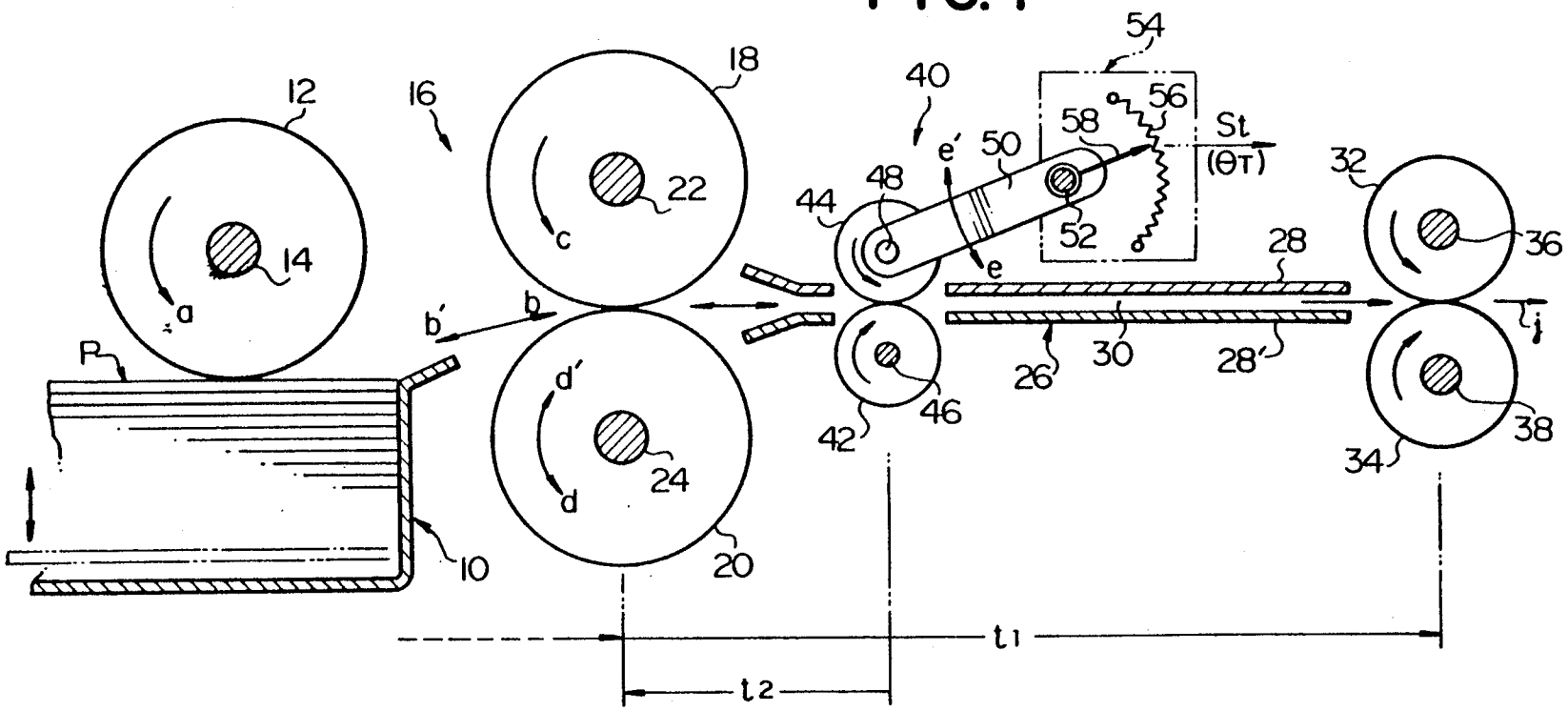
FIG. 1 is a side elevation view schematically showing the general mechanical construction and arrangement of a preferred embodiment of a sheet feeding apparatus according to the present invention.

Referring to FIG. 1, a sheet feeding apparatus embodying the present invention comprises a stationary housing structure (not shown) and a sheet supply or stocker unit 10 detachably assembled to the housing structure and having contained therein a stock of sheet materials P stacked on one another. The sheet materials P used in the sheet feeding apparatus herein shown may be sheets of paper each of which bears an image thereon or on each of which an image is to be printed or otherwise formed. On top of the stock of sheet materials P thus stored in the stocker unit 10 is positioned a pickup roller 12 carried on a drive shaft 14 having a horizontal axis of rotation fixed with respect to the housing structure and parallel with the sheet materials P in the stocker unit 10. The pickup roller 12 is to be driven for rotation in a direction indicated by arrow a about the center axis of the drive shaft 14 so that the sheet materials P stored in the stocker unit 10 are picked up and supplied from the stocker unit 10 one after another from the uppermost of the the sheet materials to the lowermost.

As well known in the art, the stock of sheet materials P is received on a vertically movable or rockable platform plate which forms part of an elevating mechanism (not shown) adapted to move or turn the platform plate upwardly and downwardly in the stocker unit 10. When the platform plate is thus moved or turned upwardly in the stocker unit 10, the uppermost one of the sheet materials P supported on the platform plate is brought into contact with the pickup roller 12 and is caused to advance forwardly from the stocker unit 10 as indicated by arrowhead b. In the description to follow, the direction represented by the arrowhead b will be referred to as forward direction of travel of a sheet material P away from the stocker unit 10. By the same token, the direction opposite to the forward direction of arrowhead b as indicated by arrowhead b' will be referred to as backward direction of travel of a sheet material P toward the stocker unit 10.

Forwardly of the pickup roller 12 is provided a feed roller assembly 16 which comprises an upper forward feed roller 18 and a lower backward/forward feed roller 20 which are held in rollable engagement with each other. The upper forward feed roller 18 and lower backward/forward feed roller 20 are carried on drive shafts 22 and 24, respectively, each having an axis of rotation fixed with respect to the housing structure and parallel with the axis of rotation of the pickup roller 12. The forward feed roller 18 and backward/forward feed roller 20 are positioned to form therebetween a nip located in the path of a sheet material P advancing in the forward direction from the stocker unit 10.

As will be understood more clearly as the description proceeds, the upper forward feed roller 18 is to be driven for rotation about the center axis of the drive shaft 22 in a direction indicated by arrow c, viz., identical with the direction in which the pickup roller 12 is to be driven for rotation about the center axis of the drive shaft 14. On the other hand, the lower backward/forward feed roller 20 is to be driven for rotation about the center axis of the drive shaft 24 either in a first direction indicated by arrow d, viz., identical with the direction of rotation c of the forward feed roller 18 or in a second direction indicated by arrow d', viz., opposite to the direction of rotation c of the forward feed roller 18.

By preference, each of the rollers 18 and 20 may be in its entirety constructed of a resilient material such as non-rigid rubber or may have its peripheral surface wrapped in or covered with a resilient pad of, for example, non-rigid rubber.

Downstream of the feed rollers 18 and 20 in the forward direction of travel of a sheet material is disposed a guide assembly 26 for guiding a sheet material P to travel forwardly away from the nip between the rollers 18 and 20. The guide assembly 26 is fixed with respect to the housing structure of the apparatus and comprises upper and lower guide plates 28 and 28' which are vertically spaced apart in parallel from each other to define therebetween a generally horizontal passageway 30. The passageway 30 thus formed in the guide assembly 26 extends forwardly away from the nip between the rollers 18 and 20 and is open at its foremost and rearmost ends.

In the vicinity of the forward end of the passageway 30 thus formed in the guide assembly 26 is provided a pair of transport rollers 32 and 34 which are held in rollable contact with each other. The transport rollers 32 and 34 are carried on shafts 36 and 38, respectively, each of which has an axis of rotation parallel with the passageway 30 in the guide assembly 26. One of the shafts 36 and 38 thus carrying the transport rollers 32 and 34, respectively, is driven for rotation about the center axis thereof so that a sheet material P forwardly withdrawn from the passageway 30 in the guide assembly 26 is conveyed past the rollers 32 and 34 toward any utilization apparatus (not shown) such as for example an image duplicating or printing apparatus. Each of the rollers 32 and 34 may be constructed of any synthetic resin or may comprise a cylindrical member of metal covered with a resilient material such as rubber.

In conjunction with the guide assembly 26 is provided a "dual-purpose" detecting assembly 40 adapted to detect the presence of a single sheet material P staying in or advancing through the passageway 30 or the presence of two or more sheet materials P allowed into the guide assembly 26. In the embodiment herein shown, such a dual-purpose detecting assembly 40 comprises a lower reference roller 42 and an upper detection roller 44 which are held in rollable contact with each other. The lower reference roller 42 and upper detection roller 44 are rotatable on shafts 46 and 48, respectively, each having a center axis parallel with the path of a sheet material P through the passageway 30 in the guide assembly 26. The shaft 46 carrying the lower reference roller 42 is fixed with respect to the housing structure of the apparatus, while the shaft 48 carrying the upper detection roller 46 is mounted on a leading end portion of a rockable arm member 50. The rockable arm member 50 is rockable on a pivot shaft 52 having an axis fixed with respect to the housing structure of the apparatus and parallel with the axes of rotation of the rollers 42 and 44. Thus, the rockable arm member 50 is pivotally movable about the center axis of the pivot shaft 52 in a first direction having the detection roller 44 moved closer to the reference roller 42 as indicated by arrowhead e and a second direction having the detection roller 44 moved away from the reference roller 42 as indicated by arrowhead e'. The rockable arm member 50 is urged to turn in the first direction indicated by arrowhead e by suitable biasing means which in the arrangement herein shown is implemented by the weights of the roller 44 and the leading end portion of the arm member 50 per se.

In association with the rockable arm member 50 having the detection roller 44 carried on one end portion thereof as above described is provided a thickness detecting device. The thickness detecting device is responsive to the thickness of a single sheet material P or the total thickness of a plurality of sheet materials P fed in the forward direction from the stocker unit 10 for producing a signal variable with the detected thickness of the sheet material or materials. In the embodiment of the present invention herein shown, such thickness detecting device is implemented by a rotary potentiometer 54 which is arranged in conjunction with the opposite end portion of the arm member 50.

As illustrated to an enlarged scale in FIG. 2A, the rotary potentiometer 54 which forms part of the dual-purpose detecting assembly 40 used in the preferred embodiment of the present invention comprises an arcuately curved resistor element 56 and a slide contact element 58 slidable on the resistor element 56. The resistor element 56 is fixed with respect to the housing structure of the apparatus and is arcuately curved about the center axis of the pivot shaft 52. The slide contact element 58 is pivotally movable with the rockable arm member 50 about the center axis of the pivot shaft 52. The resistor element 56 is connected at its opposite to terminal elements 60 and 60' which are electrically connected together across a d.c. power source 62. The slide contact element 58 is slidably received at one end on the resistor element 56 and is electrically connected at the other end to one end of the resistor element 56.

Between the slide contact element 58 and one end of the resistor element 56 is thus produced a voltage signal $S_t$ variable with the effective resistance value of the resistor element 56 with respect to the slide contact element 58. Such a voltage signal $S_t$ is a function of the angle $\theta_t$ through which the rockable arm member 50 is turned from a predetermined reference angular position about the center axis of the pivot shaft 52. The predetermined reference angular position of the rockable arm member 50 is herein assumed to be the angular position which the rockable arm member 50 assumes when the detection roller 44 is received directly on the underlying reference roller 42 with no sheet material P interposed between the rollers 42 and 44. The angle $\theta_t$ through which the rockable arm member 50 is turned from such a reference angular position is, in turn, variable with the spacing, if any, between the reference roller 42 and the detection roller 44 which may be raised over the reference roller 42. Thus, the angle $\theta_t$ of turn of the rockable arm member 50 from its reference angular position with respect to the reference roller 42 and accordingly the voltage signal $S_t$ produced by the potentiometer 54 are indicative of the thickness of a single sheet material P or the total thickness of two or more sheet materials P which may intervene between the lower reference roller 42 and the upper detection roller 44.

The detecting assembly 40 of the type using the rotary potentiometer 54 as described above is simply one of a various possible examples of the thickness detecting means provided in a sheet feeding apparatus according to the present invention. Such a detecting assembly 40 may thus be substituted by any other form of thickness detecting device such as, for example, a rotary potentiometer using a magnetoresistance effect device having a rotatable magnet in lieu of the slide contact member 58 of the described potentiometer 54. Typically used as the magnetoresistance effect device in such a rotary potentiometer is a cell of indium antimonode (InSb) as well known in the art.

Figure 3:
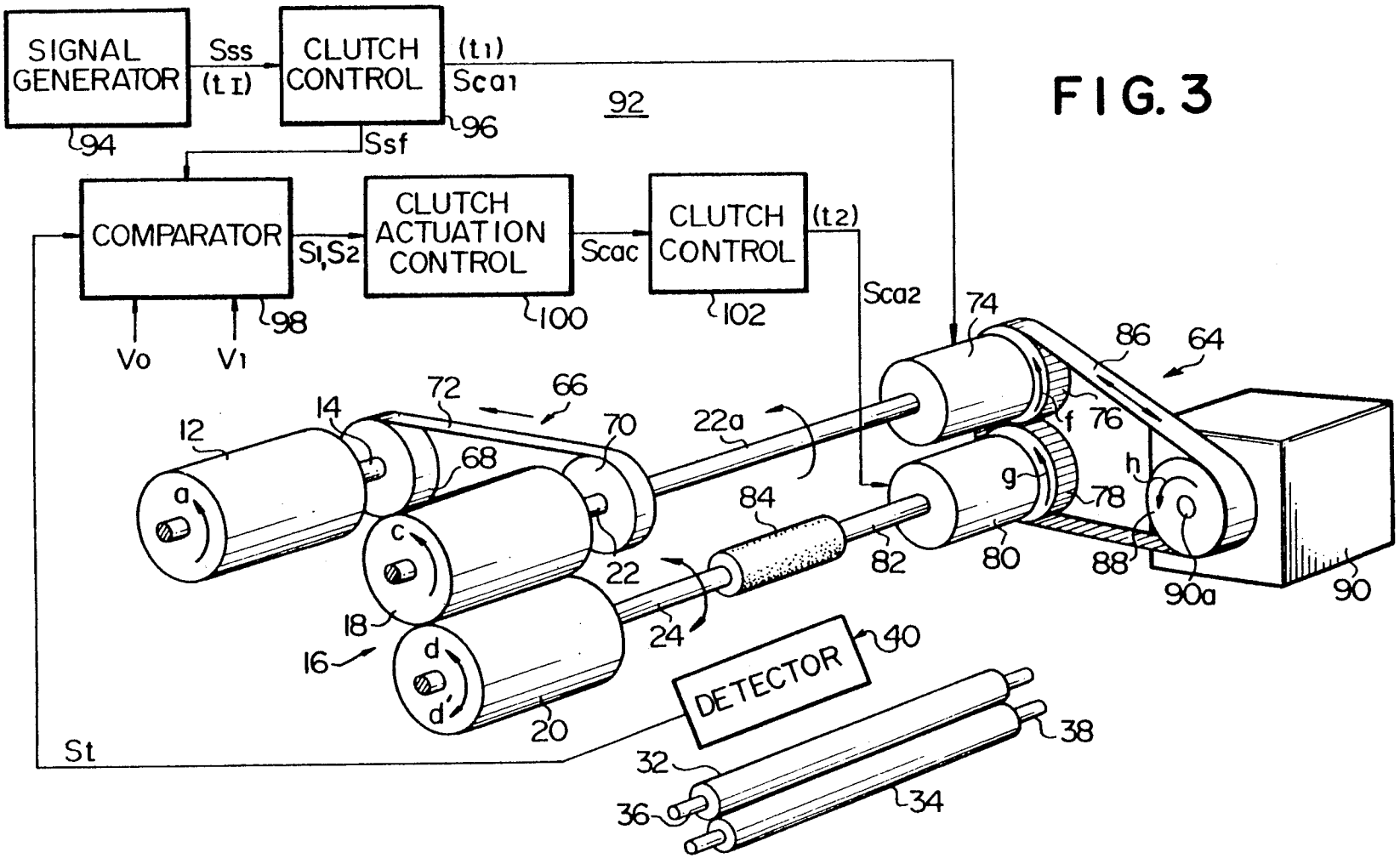
FIG. 3 is a view showing partly in perspective and partly in a block diagram the construction and arrangement of a roller drive mechanism provided for a pickup roller and a feed roller assembly included in the apparatus illustrated in FIG. 1 and the general organization of a control system predominant over the operation of the drive mechanism.

FIG. 3 shows the construction and arrangement of a roller drive mechanism 64 provided for the pickup roller 12 and the feed roller assembly 16 included in the sheet feeding apparatus generally constructed and arranged as has been described with reference to FIG. 1.

Referring to FIG. 3, the roller drive mechanism 64 provided for the pickup roller 12 and the feed roller assembly 16 comprising the forward feed roller 18 and backward/forward feed roller 20 as hereinbefore described comprises a belt and pulley assembly 66 provided in association with the pickup roller 12 and forward feed roller 18. The belt and pulley assembly 66 comprises a pulley 68 carried on and rotatable with the drive shaft 14 for the pickup roller 12 and a pulley 70 carried on and rotatable with the drive shaft 22 for the forward feed roller 18. Between these pulleys 68 and 70 is passed an endless belt 72 to transmit rotation of the pulley 70 on the drive shaft 22 for the forward feed roller 20 to the pulley 68 on the drive shaft 14 for the pickup roller 12.

The drive shaft 22 carrying the forward feed roller 20 and pulley 70 has an extension 22*a* operative connected at its leading end to a driven member of a first clutch assembly 74 which has a driving member coupled to and rotatable with a first toothed wheel 76. The first toothed wheel 76 is rotatable about its center axis in a direction identical with the respective directions of rotation a and c of the pickup roller 12 and forward feed roller 18, as indicated by arrow f. In parallel with the first toothed wheel 76 is provided a second toothed wheel 78 which is coupled to and rotatable with a driving member of a second clutch assembly 80 which has a driven member having a shaft 82 connected through a flexible coupling 84 to the drive shaft 24 carrying the backward/forward feed roller 20 as shown. The second toothed wheel 80 is rotatable about its center axis in a direction indicated by arrow g and identical with the first direction of rotation d of the backward/forward feed roller 20. An endless drive belt 86 is passed round the first and second toothed wheels 76 and 78 and further round a drive pulley 88 which is carried on and rotatable with the output shaft 90*a* of a motor 90. The motor 90 is adapted to drive the drive pulley 88 for rotation in the direction of arrow h about the center axis of the motor output shaft 90*a*.

The drive pulley 88 being thus driven for rotation in the direction of arrow h, the first toothed wheel 76 is driven for rotation in the direction of arrow f and concurrently the second toothed wheel 78 is driven for rotation in the direction of arrow g, each by means of the endless belt 86. When the first clutch assembly 74 associated with the first toothed wheel 76 is held in a coupled condition, the rotation of the toothed wheel 76 is transmitted through the first clutch assembly 74 to the forward feed roller 18 and further through the pulley 70, endless belt 72 and pulley 68 to the pickup roller 12. The pickup roller 12 and forward feed roller 18 are accordingly driven for rotation in the directions of arrows a and c about the center axes of the drive shafts 14 and 22, respectively. When the second clutch assembly 80 associated with the second toothed wheel 78 is held in a coupled condition, the rotation of the toothed wheel 78 in the direction of arrow is transmitted to the backward/forward feed roller 20 by way of the second clutch assembly 80 and the flexible coupling 84. Under this condition, the backward/forward feed roller 20 is driven for rotation in the first direction of rotation indicated by arrow d about the center axis of the drive shaft 24. On the other hand, when the second clutch assembly 80 is held in an uncoupled condition, the backward/forward feed roller 20 is isolated from the rotation of the second toothed wheel 78 and may be driven for rotation in the second direction indicated by arrowhead d' due to its frictional engagement with the forward feed roller 18.

As will be described, the second clutch assembly 80 is coupled and the backward/forward feed roller 20 is driven for rotation in the first direction when it is detected that there are two or more sheet materials P intervening between the reference and detection rollers 42 and 44 of the detecting assembly 40 and accordingly between the forward and backward/ forward feed rollers 18 and 20. As will be readily understood, the two or more sheet materials P thus intervening between the feed rollers 18 and 20 include a single properly fed sheet material P which is to be further conveyed in the forward direction indicated by arrowhead b and at least one surplus or improperly fed sheet material P which is to be conveyed in the backward direction indicated by arrowhead b'.

The backward/forward feed roller 20 being driven for rotation in the first direction in the presence of two or more sheet materials P between the feed rollers 18 and 20, the lower sheet material P or the lowermost one of the sheet materials P is forced to travel backwardly in the direction of arrowhead b' toward the stocker unit 10 while allowing the upper sheet material P or the uppermost one of the sheet materials P to travel forwardly in the direction of arrowhead b away from the stocker unit 10. The sheet material P thus driven to travel backwardly is toward the stocker unit 10 and may be returned to the stocker unit 10 with the platform plate supporting the stack of sheet materials P lowered away from the pickup roller 12 by means of the elevating mechanism associated with the stocker unit 10.

FIG. 3 further shows the general organization of a control system 92 predominant over the operation of the roller drive mechanism 64 constructed and arranged as hereinbefore described.

As shown, the control system 92 comprises a control signal generator circuit 94 operative to produce control signals on the basis of which the roller drive mechanism 64 is to operate during each cycle of operation of the apparatus. The signals to be produced by the control signal generator circuit 94 include a sheet supply signal $S_{ss}$ in accordance with which a sheet material P is to be supplied from the stocker unit 10. During each cycle of operation of the apparatus embodying the present invention, the sheet supply signal $S_{ss}$ is output from the signal generator circuit 94 with a predetermined amount of delay after the preceding cycle of operation is terminated. As will be explained in more detail, this predetermined amount of delay is required to provide an adequate time interval between the successive cycles of operation of the apparatus.

The sheet supply signal $S_{ss}$ thus output from the signal generator circuit 94 is supplied to a first clutch control circuit 96 which is electrically connected to the first clutch assembly 74 associated with the pickup roller 12 and forward feed roller 18. In response to the sheet supply signal $S_{ss}$ , the first clutch control circuit 96 generates a clutch actuation signal $S_{cal}$ effective to actuate the clutch assembly 74 to couple for a predetermined period of time $t_1$. The first clutch assembly 74 being actuated by the clutch actuation signal $S_{cal}$ thus generated by the clutch control circuit 96, the pickup roller 12 and forward feed roller 18 are driven for rotation in the directions of arrows a and c, respectively, by means of the belt and pulley assembly 66. A sheet material P is picked up from the stocker unit 10 and is driven to advance forwardly from the stocker unit 10 as indicated by arrowhead b in FIG. 1. The predetermined period of time $t_1$ for which the first clutch assembly 74 is to be maintained in the coupled condition is selected in a manner to enable a sheet material P to reach the transport rollers 32 and 34 after the sheet material P is picked up from the stocker unit 10, as indicated in FIG. 1. Such a period of time $t_1$ may vary depending on the size of the sheet material to be used and the speed at which the sheet material P is to be driven to travel by means of the forward feed roller 18 and may be adjustably preset by the first clutch control circuit 96.

The first clutch control circuit 96 is further connected to the control terminal of a comparator circuit 98 and is operative to supply a control signal $S_{sf}$ of logic "1" or "0" state to the comparator circuit 98. The control signal $S_{sf}$ of logic "1" indicates that the forward feed roller 18 is in operation driving a sheet material P to travel in the forward direction. The comparator circuit 98 has an input terminal connected to the rotary potentiometer 54 forming part of the detecting assembly 54 and is responsive to the voltage signal $S_t$ generated by the potentiometer 54. In the presence of the control signal $S_{sf}$ of logic "1" or "0" state received from the first clutch control circuit 96, the comparator circuit 98 is operative to compare the voltage signal $S_t$ supplied from the detecting assembly 40 with predetermined first and second reference voltages $V_0$ and $V_1$.

The first reference voltage $V_0$ is preset to correspond to the reference position which the rockable arm 50 of the detecting assembly 40 assumes with respect to the reference roller 42 in the absence of a sheet material P interposed between the reference and detection rollers 42 and 44. The second reference voltage $V_1$ is preset to correspond to the angular position which the rockable arm 50 will assume with respect to the reference roller 42 when a single sheet material P is interposed between the reference and detection rollers 42 and 44. Thus, the comparator circuit 98 is, in effect, operative to compare the detected angle $\theta_t$ of the rockable arm 50 about the center axis of the pivot shaft 52 with a first predetermined angle $\theta_0$ which the rockable arm 50 will have in the absence of a sheet material P between the reference and detection rollers 42 and 44 and a second predetermined angle $\theta_1$ which the rockable arm 50 will have in the presence of a single sheet material P between the rollers 42 and 44.

If it is found that the detected angle $\theta_t$ of the rockable arm 50 is larger than the first predetermined angle $\theta_0$, the comparator circuit 98 outputs a first output signal $S_1$ of logic "1" state indicating that there is at least one sheet material P interposed between the reference and detection rollers 42 and 44. On the other hand, when it is found that the detected angle $\theta_t$ of the rockable arm 50 is larger than the second predetermined angle $\theta_1$, the comparator circuit 98 outputs a second output signal $S_2$ of logic "1" state indicating that there are two or more sheet materials P interposed between the rollers 42 and 44.

The first or second output signal $S_1$ or $S_2$ of logic "1" state is thus generated by the comparator circuit 98 in the presence of the control signal $S_{sf}$ of logic "1" or "0" state from the first clutch control circuit 96. The signal $S_1$ or $S_2$ is supplied to a clutch actuation control circuit 100 which is operative to produce an output signal $S_{cac}$ in response to the first or second output signal $S_1$ or $S_2$ from the comparator circuit 98. The control circuit 100 produces the output signal $S_{cac}$ in response to the second output signal $S_2$ of logic "1" state when the control signal $S_{sf}$ supplied from the first clutch control circuit 96 to the comparator circuit 98 has the logic "1" state. The clutch actuation control circuit 100 is operative to produce the output signal $S_{cac}$ also in response to the first output signal $S_1$ of logic "1" state from the comparator circuit 98 provided there is the control signal $S_{sf}$ of logic "0" state supplied from the first clutch control circuit 96 to the comparator circuit 98. Thus, the signal $S_{cac}$ is produced by the clutch actuation control circuit 100 in the presence of (1) the first output signal $S_1$ of logic "1" state from the comparator circuit 98 and the control signal $S_{sf}$ of logic "0" state from the clutch control circuit 96, or (2) the second output signal $S_2$ of logic "1" state from the comparator circuit 98 and the control signal $S_{sf}$ of logic "1" state from the clutch control circuit 96.

The signal $S_{cac}$ thus produced by the clutch actuation control circuit 100 is supplied to a second clutch control circuit 102 which is electrically connected to the second clutch assembly 80 associated with the backward/forward feed roller 20. In response to the signal $S_{cac}$, the second clutch control circuit 102 generates a clutch actuation signal $S_{ca2}$ effective to actuate the second clutch assembly 80 to couple for a predetermined period of time $t_2$. The second clutch assembly 80 being actuated by the clutch actuation signal $S_{ca2}$ thus generated by the second clutch control circuit 102, the backward/forward feed roller 20 is driven for rotation in the first direction indicated by arrowhead d by means of the flexible coupling 84.

The backward/forward feed roller 20 being thus driven for rotation in the first direction in the presence of two or more sheet materials P between the feed rollers 18 and 20, the lower sheet material P or the lowermost one of the sheet materials P is forced to travel toward the stocker unit 10 as indicated by arrowhead b' while allowing the upper sheet material P or the uppermost one of the sheet materials P to travel away from the stocker unit 10 as indicated by arrowhead b. As indicated in FIG. 1, the predetermined period of time $t_2$ for which the second clutch assembly 80 is to be maintained in the coupled condition is selected preferably in a manner to enable a sheet material P to reach a position having its leading end located immediately anterior, in the forward direction of travel of a sheet material, to the nip between the feed rollers 18 and 20 after the sheet material P is driven to travel backwardly from between the reference and detection rollers 42 and 44 of the detecting assembly 40. Generally, the predetermined period of time $t_2$ is selected such that a sheet material P detected to have been improperly fed in the forward direction is enabled to move in the direction of arrowhead b' from a predetermined position with respect to the detecting assembly 40 to a predetermined position with respect to the stocker unit 10 during the predetermined period of time $t_2$. Such a period of time $t_2$ may also vary depending on the size of the sheet material to be used and the speed at which the sheet material P is to be driven to travel backwardly by means of the backward/forward feed roller 20 and may be adjustably preset by the second clutch control circuit 102.

Where an improperly fed or surplus sheet material P is to be returned to the stocker unit 10 as previously noted, the period of time $t_2$ for which the second clutch assembly 80 is to be maintained in the coupled condition may be selected to enable the surplus sheet material P to return to the stocker unit 10 after the sheet material P is driven to travel backwardly from between the reference and detection rollers 42 and 44 of the detecting assembly 40.

It may happen that the comparator circuit 98 remains in a state producing the second output signal $S_2$ of logic "1" state upon lapse of the predetermined period of time $t_2$ after the clutch actuation signal $S_{ca2}$ is supplied from the second clutch control circuit 102. This will occur when there were more than two sheet materials P concurrently supplied from the stocker unit 10 to the feed rollers 18 and 20 and as a consequence there are still two or more sheet materials P between the feed rollers 18 and 20 after the lowermost one of the initial three or more sheet materials P was returned toward the stocker unit 10. In such an occasion, the clutch actuation control circuit 100 produces the output signal $S_{cac}$ and accordingly the second clutch assembly 80 is actuated to couple repeatedly until all the improperly fed or surplus sheet materials P are returned toward the stocker unit 10. It will be understood that this is the case (1) for the signal $S_{cac}$ produced by the clutch actuation control circuit 100.

It may also happen that the comparator circuit 98 produces the first output signal $S_1$ of logic "1" state in the presence of the control signal $S_{sf}$ of logic "0" state supplied from the first clutch control circuit 96 to the comparator circuit 98. This will occur when there is a single sheet material P or there are two or more sheet materials P existing between the feed rollers 18 and 20 with the first clutch assembly 74 held in the uncoupled condition in the absence of the sheet supply signal $S_{ss}$ supplied from the control signal generator circuit 94. In such an occasion, the clutch actuation control circuit 100 also produces the output signal $S_{cac}$ and accordingly the second clutch assembly 80 is actuated to couple to feed the sheet material or sheet materials P backwardly toward the stocker unit 10. This is the case (1) for the signal $S_{cac}$ produced by the clutch actuation control circuit 100.

Figure 4:
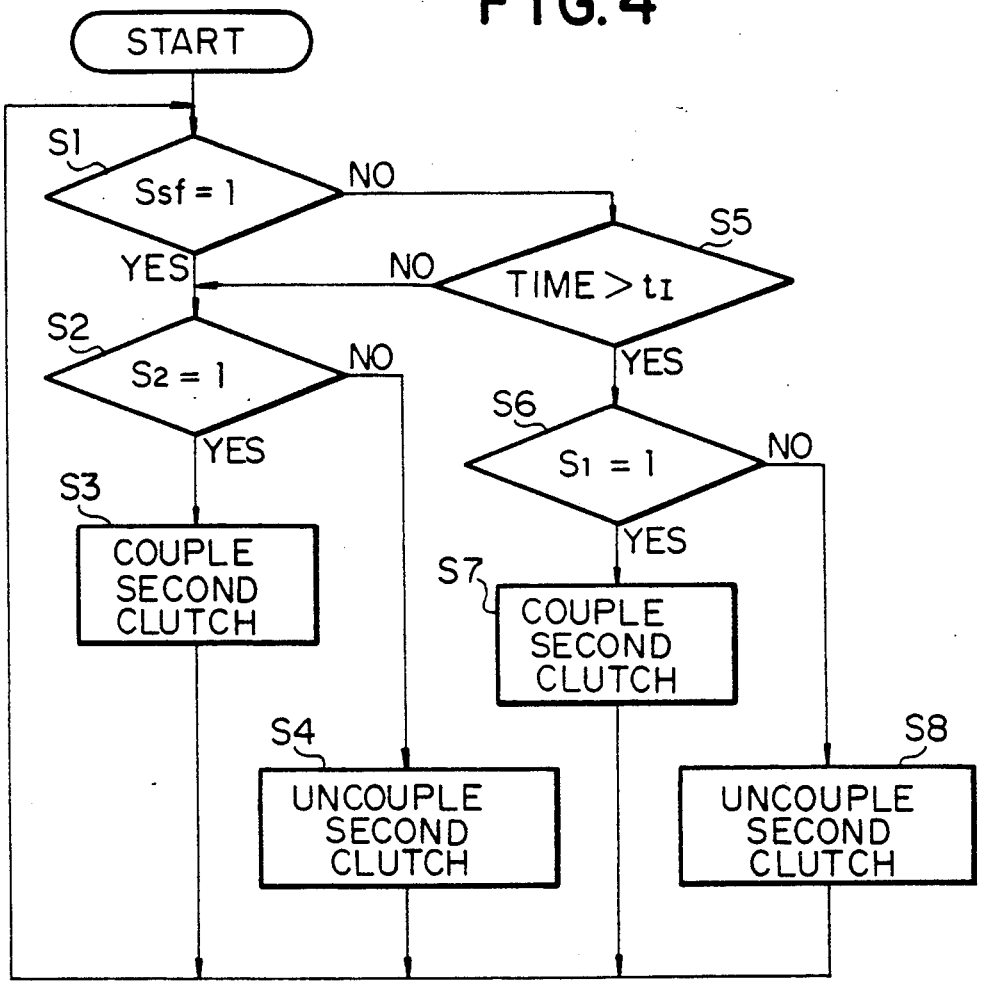
FIG. 4 is a flowchart showing the routine program in accordance with which the roller drive mechanism forming part of the sheet feeding apparatus illustrated in FIG. 3 is to operate under the control of the control system also illustrated in FIG. 3.

FIG. 4 is a flowchart showing the routine program in accordance with which the roller drive mechanism 64 forming part of the sheet feeding apparatus embodying the present invention is to operate under the control of the control system 92 constructed and arranged as hereinbefore described.

The routine program for the operation of the roller drive mechanism 64 starts with step S1 at which it is checked if the first clutch assembly 74 is in operation or not. As has been described, the first clutch assembly 74 is actuated into operation by the clutch actuation signal $S_{cal}$ supplied from the first clutch control circuit 96 in response to the sheet supply signal $S_{ss}$ output from the control signal generator circuit 94. In the presence of the clutch actuation signal $S_{cal}$ supplied to the first clutch assembly 74, there is the control signal $S_{sf}$ of logic "1" state supplied from the first clutch control circuit 96 to the comparator circuit 98. It may thus be detected at step $S_1$ whether the control signal $S_{sf}$ from the first clutch control circuit 96 has the logic "1" state or not.

When it is found at step $S_1$ that the first clutch assembly 74 is in operation so that both of the pickup roller 12 and forward feed roller 18 are being driven for rotation to feed a sheet material P in the forward direction, the step $S_1$ is followed by step S2. At step S2 it is checked whether or not there are two or more sheet materials P intervening between the forward and backward/forward feed rollers 18 and 20. This test may be made through detection of the second output signal $S_2$ of logic "1" state output from the comparator circuit 98.

If it is found at step S2 that there are two or more sheet materials P intervening between the feed rollers 18 and 20, the signal $S_{cac}$ is produced by the clutch actuation control circuit 100 in the presence of the second output signal $S_2$ of logic "1" state from the comparator circuit 98 and the control signal $S_{sf}$ of logic "1" state from the clutch control circuit 96. The signal $S_{cac}$ thus produced by the clutch actuation control circuit 100 is supplied to the second clutch control circuit 102 and enable the control circuit 102 to supply the clutch actuation signal $S_{ca2}$ to the second clutch assembly 80. The second clutch assembly 80 is actuated to couple by the signal $S_{ca2}$ and as a consequence the backward/forward feed roller 20 is driven for rotation in the first direction indicated by arrowhead d by means of the flexible coupling 84.

The backward/forward feed roller 20 being thus driven for rotation in the first direction, the lower sheet material P or the lowermost one of the sheet materials P intervening between the feed rollers 18 and 20 is forced to return toward the stocker unit 10 as indicated by arrowhead b' while allowing the upper sheet material P or the uppermost one of the sheet materials P to advance forwardly away from the stocker unit 10 as indicated by arrowhead b. The second clutch assembly 80 is held in the coupled condition and accordingly the backward/ forward feed roller 20 is driven for rotation in the direction of arrowhead d for the predetermined period of time $t_2$ required for the lower sheet material P or the lowermost one of the sheet materials P to reach the position having its leading end located immediately anterior to the nip between the feed rollers 18 and 20 after the sheet material P is driven to travel backwardly from between the reference and detection rollers 42 and 44 of the detecting assembly 40.

On termination of the predetermined period of time $t_2$, the step S3 is followed by step $S_1$ and, if the answer for this step $S_1$ is given in the affirmative and the answer for the subsequent step $S_2$ also given in the affirmative, it is determined that the surplus sheet material P has not yet been moved back to the proper position anterior to the nip between to the feed rollers 18 and 20 and still intervenes between the rollers 18 and 20. In this occasion, the step $S_2$ is followed by step S3 so that the second clutch assembly 80 is actuated for a second time to enable the sheet material to reach the position having its leading end located immediately anterior to the nip between the feed rollers 18 and 20.

If there is a single sheet material P intervening between the feed rollers 18 and 20, the answer for step $S_2$ is given in the negative, in which instance the step $S_2$ is followed by step S4 to uncouple the second clutch assembly 80. With the second clutch assembly 80 thus uncoupled, the backward/forward feed roller 20 is isolated from the driving effort originating in the motor 90 and is driven for rotation in the second direction indicated by arrowhead d' by its frictional engagement with the forward feed roller 18 through the single sheet material P being driven to travel forwardly between the rollers 18 and 20.

After the second clutch assembly 80 is thus uncoupled, the step S4 is followed by step $S_1$ and, if the answer for this step $S_1$ and furthermore the answer for the subsequent step $S_2$ are given each in the affirmative, it is determined that there is another improperly fed or surplus sheet material P intervening between the feed rollers 18 and 20. In this occasion, the step $S_2$ is further followed by step S3 and the second clutch assembly 80 is actuated to drive the second surplus sheet material P to the position having its leading end located immediately anterior to the nip between the feed rollers 18 and 20. The series of steps S1, S2 and S3 or the series of steps S1, S2, S3, S1, S2 and S4 is repeated until all the surplus sheet materials are returned from the detecting assembly 40 toward the stocker unit 10.

When it is found at step S1 that the first clutch assembly 74 is not in operation so that each of the pickup roller 12 and forward feed roller 18 is held at rest, it is checked at step S5 if a predetermined period of time $t_I$ has lapsed after the first clutch assembly 74 was uncoupled during the cycle of operation which has just been terminated. This period of time $t_I$ is selected to provide an adequate time interval between the termination of a cycle of operation and the start of the subsequent cycle of operation in which another sheet material P is to be fed from the stocker unit 10. The answer given in the affirmative for step S5 is thus indicative of the fact that the cycle of operation to follow the cycle of operation which has just terminated is not yet started and accordingly that there is not yet supplied the sheet supply signal $S_{ss}$ from the control signal generator circuit 94 for the subsequent cycle of operation.

The first clutch assembly 74 which has once been actuated to couple by the clutch actuation signal $S_{cal}$ from the first clutch control circuit 96 is uncoupled at the end of the predetermined period of time $t_1$ when the sheet material P driven to travel in the forward direction reaches the transport rollers 32 and 34. Depending on the length of the sheet material P used, it may happen that the sheet material P has its trailing end portion still located between the feed rollers 18 and 20 after the leading end of the sheet material P has reached the nip between the transport rollers 32 and 34. This will occur when the sheet material P used is longer than the distance between the nip between the feed rollers 18 and 20 and the nip between the transport rollers 32 and 34. During the cycle of operation subsequent to the cycle of operation which has just been terminated, a new sheet material for use in the subsequent cycle of operation is fed from the stocker unit 10 and is passed through the nip between the feed rollers 18 and 20. If the preceding cycle of operation is followed by the subsequent cycle of operation immediately, viz., with no time interval provided between the successive cycles of operation, the newly fed sheet material is present between the feed rollers 18 and 20 concurrently with and in addition to the trailing end portion of the sheet material P used in the preceding cycle of operation. The subsequent cycle of operation is started in the predetermined period of time $t_I$ after the preceding cycle of operation is terminated to preclude the overlapped feeding of sheet materials P as would otherwise be caused through the feed rollers 18 and 20. The predetermined period of time $t_I$ is thus selected in consideration of the possible length of the sheet material P longer than the distance between the nip between the feed rollers 18 and 20 and the nip between the transport rollers 32 and 34.

If it is found at step S5 that the predetermined period of time $t_I$ has not yet lapsed after the first clutch assembly 74 was uncoupled during the cycle of operation which has just been terminated, there is the possibility of the overlapped feeding of sheet materials P occurring between the successive cycles of operation. Thus, when the answer for step S5 is given in the negative, the step S5 is followed by step S2 to check for such overlapped feeding of sheet materials P and may further followed by the step S3 or, if necessary, by the series of steps S3, S1, S5, S2 and S4.

By the termination of the predetermined period of time $t_I$ after the first clutch assembly 74 was uncoupled during the preceding cycle of operation, the sheet material P which was used in the particular cycle of operation is forwardly moved past the nip between the feed rollers 18 and 20 and, for this reason, there is no possibility of the overlapped feeding of sheet materials P occurring between the successive cycles of operation. Thus, if the answer for step S5 is given in the affirmative after it has been detected at step S1 that the subsequent cycle of operation has not yet been started, there must be no sheet material P remaining between the feed rollers 18 and 20. It may nevertheless happen for any reason that a sheet material P or two or more sheet materials P are improperly present between the feed rollers 18 and 20. When the answer for step S5 is given in the affirmative, it is thus checked at step S6 whether or not there is a sheet material or sheet materials P intervening between the feed rollers 18 and 20. This test may be made through detection of the first output signal $S_1$ of logic "1" state output from the comparator circuit 98.

If it is found at step S6 that there is a sheet material or sheet materials P improperly present between the feed rollers 18 and 20, the step S5 is followed by step S7 at which the signal $S_{cac}$ is produced by the clutch actuation control circuit 100 and the second clutch control circuit 102 is enabled to supply the clutch actuation signal $S_{ca2}$ to the second clutch assembly 80. The second clutch assembly 80 being thus actuated to couple, the backward/forward feed roller 20 is driven for rotation in the first direction indicated by arrowhead d so that the sheet material P or the lowermost one of the sheet materials P improperly intervening between the feed rollers 18 and 20 is forced to return toward the stocker unit 10. It may be noted that the sheet material intervening between the feed rollers 18 and 20 is directly contacted by both of the rollers 18 and 20 under these conditions so that there is produced a buzz from between the feed rollers 18 and 20 being driven to turn in the opposite directions on the sheet material intervening between the rollers 18 and 20. When a single properly fed sheet material P is being driven to travel forwardly between the rollers 18 and 20 as at step S4, the backward/forward feed roller 20 is driven for rotation in the second direction d' by its frictional engagement with the forward feed roller 18 as has been described. Under these conditions, there is no buzzing sound produced from between the feed rollers 18 and 20 being driven to turn in the same directions on the sheet material intervening between the rollers 18 and 20.

On termination of the predetermined period of time $t_2$ after the second clutch assembly 80 was actuated to couple, the step S7 is followed by step S1 and, if the answer for this step S1 is given in the negative and the answer for the subsequent step S5 given in the affirmative, it is further tested at step S6 whether there is at least one sheet material P still remaining between the feed rollers 18 and 20. If the answer for this step S6 is given in the affirmative for a second time, the second clutch assembly 80 is actuated at step S7 to enable the sheet material P or the lowermost one of the sheet materials P to reach the position having its leading end located immediately anterior to the nip between the feed rollers 18 and 20.

If there is no sheet material found to intervene between the feed rollers 18 and 20 or when the sheet material P or sheet materials P were found to improperly intervene between the rollers 18 and 20 have been returned toward the stocker unit 10, the answer for step S6 is given in the negative. In this instance, the step S6 is followed by step S8 to uncouple the second clutch assembly 80. The series of steps S1, S5, S6 and S7 or the loop of the steps S1, S5, S6, S7, S1, S5, S6 and S8 is repeated until all the sheet materials P which have been improperly present between the feed rollers 18 and 20 are returned toward the stocker unit 10.

As has been described in detail, a sheet material P may happen to have its trailing end portion interposed between the feed rollers 18 and 20 after the leading end of the sheet material P has reached the nip between the transport rollers 32 and 34. If a cycle of operation of the apparatus is immediately followed by the subsequent cycle of operation, there may be present between the feed rollers 18 and 20 not only the trailing end portion of the sheet material P used in the preceding cycle of operation but the sheet material newly fed from the stocker unit for use in the subsequent cycle of operation. Such overlapped feeding of sheet materials P through the feed rollers 18 and 20 can be precluded assuredly through provision of the adequate time interval between the successive cycles of operation of the apparatus. Failure to preclude such overlapped feeding of sheet materials would cause jamming of a sheet material during the subsequent cycle of operation.

A stack of sheet materials is stored typically in a sheet supply cassette detachably assembled to the apparatus. If there is a sheet material remaining on the feed roller assembly 16 when the sheet supply cassette is exchanged with another cassette storing sheet materials of a different size, the operator is required to remove the remaining sheet material out of the apparatus before the operator manipulates the apparatus to start the first cycle of operation using the new sheet supply cassette. The series of steps subsequent to the S5 in the routine program hereinbefore described with reference to FIG. 4 is useful not only for the prevention of overlapped feeding of sheet materials but also for the elimination of such an additional servicing procedure to be performed by the operator. The apparatus embodying the present invention is thus characterized in that the signal $S_f$ out-out from the detecting assembly 40 is utilized for dual purposes of detecting the presence of two or more sheet materials during forward feeding of a properly fed sheet material and detecting the presence of s single sheet material or two or more sheet materials when there is no sheet material being fed forwardly.

Figure 2:
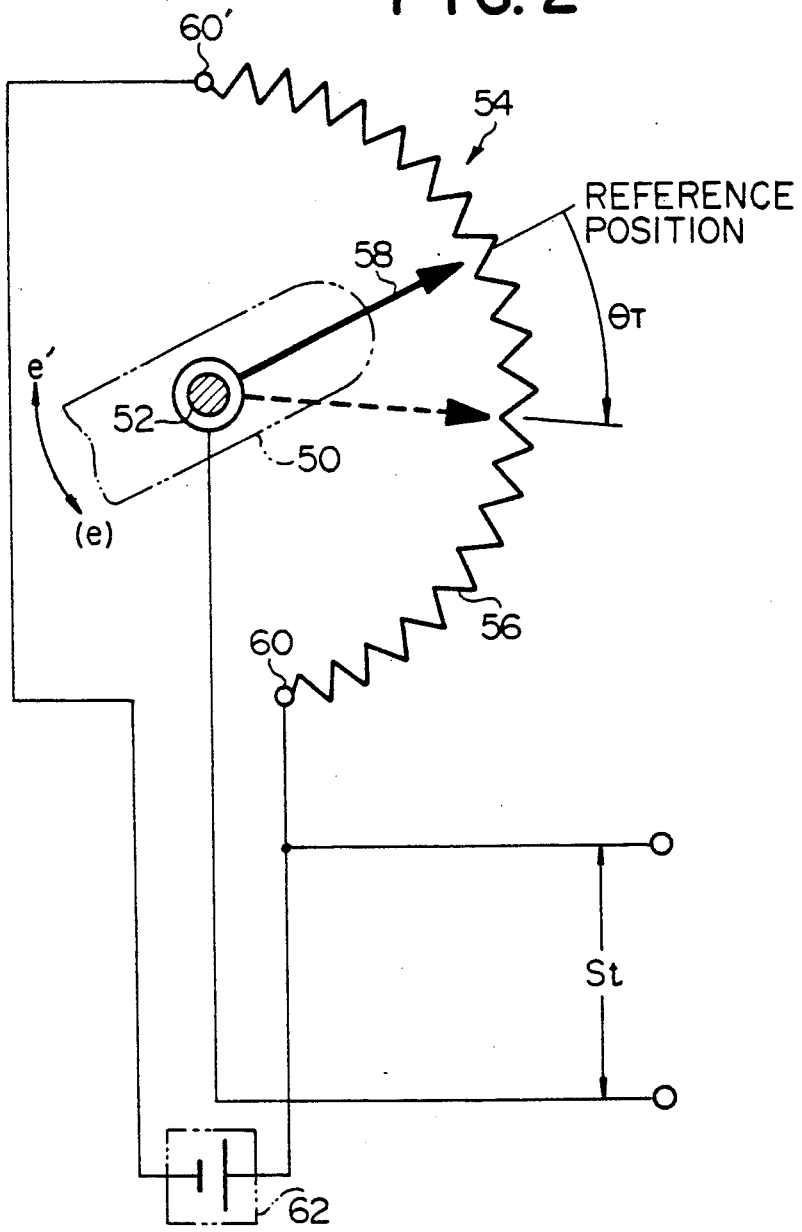
FIG. 2 is a schematic view showing the general arrangement of an example of a detecting assembly included in the sheet feeding apparatus illustrated in FIG. 1.
Figure 5:
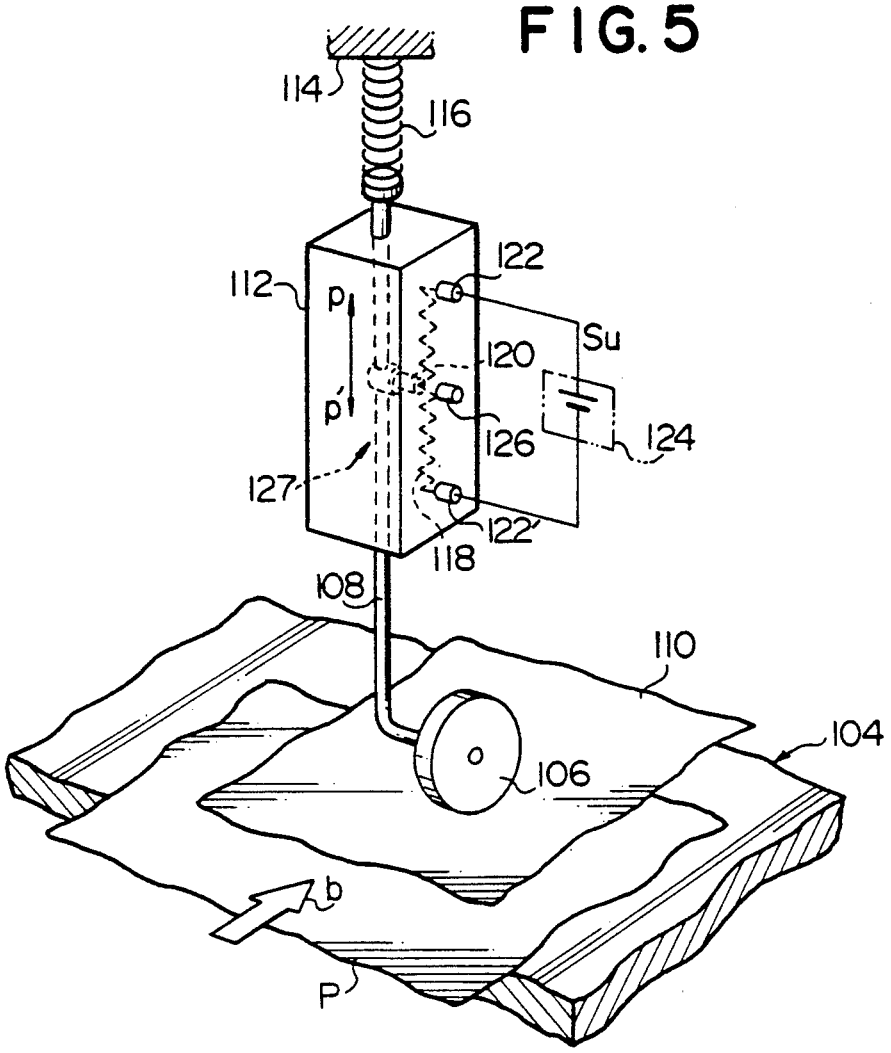
FIG. 5 is a perspective view showing the arrangement of another example of a detecting assembly which may be used in a sheet feeding apparatus according to the present invention as in substitution for the detecting assembly included in the sheet feeding apparatus illustrated in FIG. 1.

FIG. 5 shows the arrangement of another example of a dual-purpose detecting assembly which may be used in a sheet feeding apparatus according to the present invention in substitution for, for example, the detecting assembly 40 included in the sheet feeding apparatus hereinbefore described with reference to FIGS. 1 to 3.

The dual-purpose detecting assembly herein shown comprises a reference member 104 having a flat upper face defining a horizontal reference plane. A detection roller 106 is rotatably carried on a horizontally extending lower end portion of a vertically elongated support rod 108. The detection roller 106 has an axis of rotation parallel with the horizontal upper face of the reference member 104 and is held in rollable contact with the upper face of the reference member 104. A sheet material P is to be driven to travel on the horizontal upper face of the reference member 104 in the forward direction indicated by arrow b and will thus intervene between the upper face of the reference member 104 and the detection roller 106 rolling on the sheet material P.

The reference member 104 and the detection roller 106 are located intermediate between the feed roller assembly 16 and the combination of the transport rollers 32 and 34 are capable of forming therebetween a clearance located in the path of a sheet material P fed from the stocker unit 10 by the forward feed roller 18. The axis of rotation of the detection roller 106 is directed perpendicularly in non-intersecting relationship to the direction of arrow b in which the sheet material P is to be driven to travel forwardly on the reference member 104.

By preference, a thin, flexible or pliable, resistance reducing film strip 110 of, for example, Teflon (R.T.M.) is placed between the upper face of the reference member 104 and the detection roller 106 as shown. This resistance reducing film strip 110 is used for the purpose of reducing the friction between the sheet material P travelling on the upper face of the reference member 104 and the detection roller 106 rolling on the resistance reducing film strip 110.

The elongated support rod 108 extends downwardly from a stationary casing 112 fixed with respect to the housing structure of the apparatus, a portion of the housing structure being herein shown at 114. The support rod 108 extends upwardly through this stationary casing 112 and is fastened at its upper end to the housing structure 114 of the apparatus by means of an appropriate elastic element. The elastic element through which the support rod 108 thus depends downwardly from the housing structure 114 is herein provided by a helical compression spring 116 which is anchored at one end to the housing structure 114 and at the other to the upper end of the support rod 108 as shown. The spring 116 provided between the housing structure 114 and the support rod 108 facilitates the detection roller 106 to accurately and smoothly follow the variation in the thickness of the sheet material P or the total thickness of the two or more sheet materials P which may intervene between the reference member 104 and resistance reducing film strip 110. The spring 116 is further useful for precluding the detection roller 106 from floating over the resistance reducing film strip 110 as might be causes for one reason or another.

Within the stationary casing 112 are disposed a vertically elongated resistor element 118 and a slide contact element 120 movable in parallel with the resistor element 118. The resistor element 118 is fixed within the casing 112 and is connected at its opposite ends to terminal elements 122 and 122' which are connected together across a d.c. power source 124. The slide contact element 120 is securely carried on a vertically extending intermediate portion of the support rod 108 and is caused to slide upwardly or downwardly on the resistor element 118 as the support rod 108 is moved upwardly or downwardly as indicated by arrowheads p and p', respectively. The slide contact element 120 is connected by means of a flexible conductor (not shown) to a terminal element 126 fast on the casing 112. The terminal element 126 is connected to a suitable control system which is herein assumed to be similar to the control system 92 described with reference to FIG. 3. It will be apparent that the combination of the resistor and slide contact elements 118 and 120 arranged as above described provides a linear potentiometer 127.

Between the slide contact element 120 and one end of the resistor element 118 of the potentiometer 127 is produced a voltage signal $S_u$ variable with the effective resistance value of the resistor element 118 with respect to the slide contact element 120. Such a voltage signal $S_u$ is a function of the distance of the detection roller 106 from a predetermined reference position which the roller 106 has with respect to the upper face of the reference member 104. The predetermined reference position of the detection roller 106 is herein assumed to be the vertical position which the detection roller 106 assumes when the detection roller 106 or more exactly the resistance reducing film strip 110 is received directly on the underlying upper face of the reference member 104 with no sheet material P interposed between the reference member 104 and film strip 110. The distance which the detection roller 106 may be moved upwardly from such a reference position is, in turn, variable with the spacing, if any, between the upper face of the reference member 104 and the detection roller 106 or more exactly the resistance reducing film strip 110 which may be raised over the upper face of the reference member 104.

The distance of the detection roller 106 from its reference position with respect to the upper face of the reference member 104 and accordingly the voltage signal $S_u$ produced by the linear potentiometer 127 are indicative of the thickness of a single sheet material P or the total thickness of two or more sheet materials P which may intervene between the lower reference roller 42 and the upper detection roller 44. The voltage signal $S_u$ thus indicative of the thickness of a sheet material or materials P is supplied to the control system similar to the control system 92 illustrated in FIG. 3 and is used as has been described with reference to FIG. 4. It will thus be apparent that the detecting assembly using the linear potentiometer 127 is essentially similar in effect to the rotary potentiometer 54 used in the detecting assembly 40 included in the sheet feeding apparatus hereinbefore described with reference to FIGS. 1 to 3.

Figure 6:
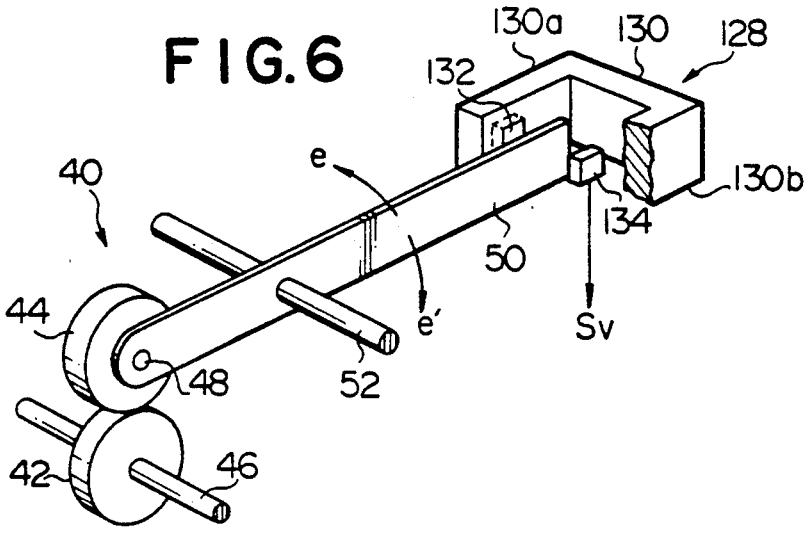
FIG. 6 is a perspective view showing the arrangement of still another example of a detecting assembly which may be used in a sheet feeding apparatus according to the present invention.

FIG. 6 shows the arrangement of still another example of a dual-purpose detecting assembly which may be used in a sheet feeding apparatus according to the present invention.

The dual-purpose detecting assembly herein shown is similar to the detecting assembly 40 included in the apparatus described with reference to FIGS. 1 to 3 in that a lower reference roller 42 and an upper detection roller 44 rotatable on shafts 46 and 48, respectively, are held in rollable contact with each other and the detection roller 46 is mounted on a leading end portion of a rockable arm member 50. The rockable arm member 50 is rockable on a pivot shaft 52 parallel with the rollers 42 and 44 in a first direction having the detection roller 44 moved closer to the reference roller 42 as indicated by arrowhead e and a second direction having the detection roller 44 moved away from the reference roller 42 as indicated by arrowhead e'. The rockable arm member 50 is urged to turn in the first direction indicated by arrowhead e by the weights of the roller 44 and the leading end portion of the arm member 50 per se. The arrangement including the reference and detection rollers 42 and 44 and the rockable arm member 50 is thus similar to its counterpart of the apparatus described with reference to FIGS. 1 to 3. The rollers 42 and 44 and the rockable arm member 50 are provided in conjunction with a guide assembly 26 forming a horizontal passageway 30 through which a sheet material P is to be guided to travel forwardly away from the nip between the feed rollers 18 and 20.

The detecting assembly shown in FIG. 6 further comprises a thickness detecting device 128 of the type operative to optically detect the thickness of a single sheet material P or the total thickness of a plurality of sheet materials P fed in the forward direction from the stocker unit 10 and produce a signal variable with the detected thickness of the sheet material or materials. In the detecting assembly herein shown, such an optical thickness detecting device 128 is arranged in conjunction with the leading end portion of the arm member 50 opposite to the detection roller 44.

The thickness detecting device 128 comprises a generally U-shaped support member 130 having a pair of side arm portions **130*a* and 130*b* horizontally spaced apart in parallel from each other on both sides of the leading end portion of the arm member 50. In these side arm portions 130*a* and 130*b* of the support member 130 are embedded or otherwise securely supported a light emitter device 132 and a light receiver device 134, respectively. The light emitter device 132 may be provided in the form of a semiconductor light emitting diode (LED) or a lamp adapted to emit a collimated beam of light, and the light receiver device 134** may be implemented by a suitable photoelectric transducer such as a photoconductive cell, a photodiode, a phototransistor, or an array of semiconductor charge coupled devices (CCD).

The light emitter device 132 and the light receiver device 134 are located in alignment with each other on both side of a vertical plane on which the rockable arm member 50 is rockable about the center axis of the pivot shaft 52. A beam of light emanating from the light emitter device 132 is thus directed toward the light receiver device 134. When the rockable arm member 50 has an angular position having its leading end located off the path of the beam of light from the light emitter device 132 toward the light receiver device 134, the beam of light issuing from the light emitter device 132 is in a major proportion allowed to reach the light receiver device 134. As the rockable arm member 50 turns from such an angular position about the center axis of the pivot shaft 52, the beam of light emitted from the light emitter device 132 will be intercepted in an increasing proportion by the leading end portion of the rockable arm member 52. Responsive to the light thus received from the light emitter device 132, the light receiver device 134 generates an analog electrical signal $S_v$ which is variable with the quantity of the light allowed to reach the light receiver device 134.

The analog electrical signal $S_v$ thus generated by the light receiver device 134 is a function of the angle through which the rockable arm member 50 is turned from a predetermined reference angular position about the center axis of the pivot shaft 52. As in the detecting assembly 40 of the embodiment described with reference to FIGS. 1 to 3, the predetermined reference angular position of the rockable arm member 50 is assumed to be the angular position which the rockable arm member 50 assumes when the detection roller 44 is received directly on the underlying reference roller 42 with no sheet material P interposed between the rollers 42 and 44.

As has been noted, the angle through which the rockable arm member 50 is turned from such a reference angular position is, in turn, variable with and accordingly indicative of the thickness of a single sheet material P or the total thickness of two or more sheet materials P which may intervene between the lower reference roller 42 and the upper detection roller 44. The voltage signal $S_v$ thus indicative of the thickness of a sheet material or materials P is supplied to a control system similar to the control system 92 illustrated in FIG. 3 and is also used as has been described with reference to FIG. 4.

Figure 7A:
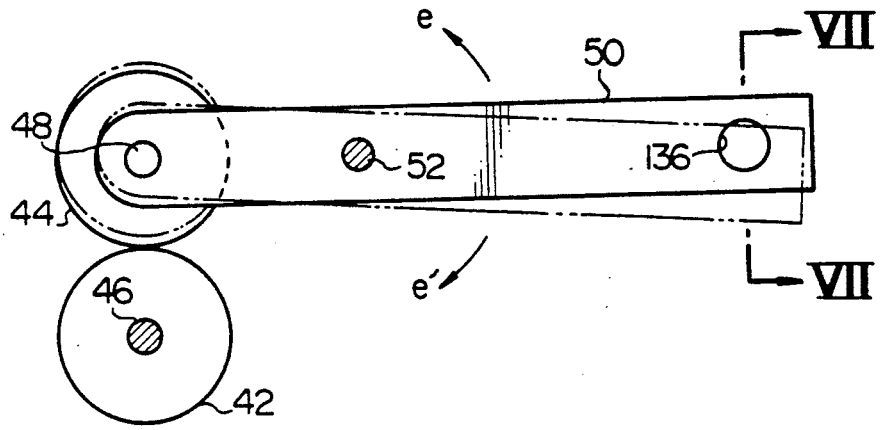
FIG. 7A is a side elevation view showing the arrangement of still another example of a detecting assembly which may be used in a sheet feeding apparatus according to the present invention.
Figure 7B:
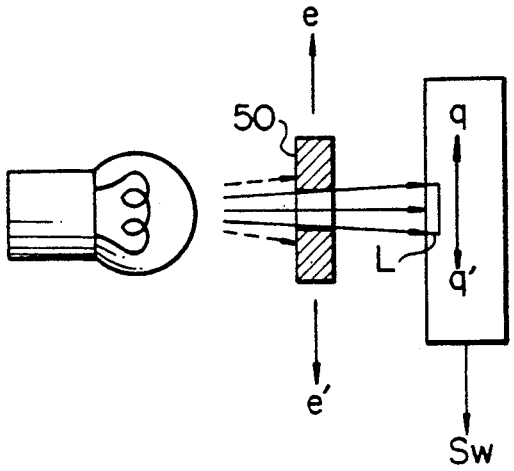
FIG. 7B is a schematic sectional view taken on line VII—VII in FIG. 7A.

FIGS. 7A and 7B show the arrangement of still another example of a dual-purpose detecting assembly which may be used in a sheet feeding apparatus according to the present invention as in substitution for the detecting assembly included in the embodiment described with reference to FIGS. 1 to 3.

The dual-purpose detecting assembly herein shown is a modification of the optical detecting assembly hereinbefore described with reference to FIG. 6 and comprises reference and detection rollers 42 and 44, rockable arm member 50 and light emitter and receiver devices 132 and 134. As in the detecting assembly shown in FIG. 6, the light emitter device 132 and the light receiver device 134 are located in alignment with each other on both side of a vertical plane on which the rockable arm member 50 is rockable about the center axis of the pivot shaft 52. The light emitter device 132 may be provided in the form of a lamp adapted to emit a diverging beam of light as shown in FIG. 7B and the light receiver device 134 may be implemented typically by an array of semiconductor charge coupled devices (CCD) which are arranged vertically.

In the detecting assembly shown in FIGS. 7A and 7B, the rockable arm member 50 has a horizontally open aperture 136 formed in its leading end portion. The diverging beam of light emanating from the light emitter device 132 and directed toward the light receiver device 134 is allowed to reach the light receiver device 134 through the aperture 136 in the leading end portion of the rockable arm member 50. The light thus incident on the light receiver device 134 forms a bright spot L on the light receiver device 34. An angular movement of the rockable arm member 50 about the center axis of the pivot shaft 52 causes a change in the location of the aperture 136 with respect to the light receiver device 134 so that the bright spot L formed on the light receiver device 134 moves upwardly or downwardly on the device 134 as indicated by arrows q and q', respectively. Responsive to such movement of the bright spot L on the light receiver device 134, the light receiver device 134 generates an electrical signal $S_{w'}$ which corresponds to and accordingly indicative of the location of the bright spot L formed on the device 134.

The signal $S_{w'}$ thus generated by the light receiver device 134 is also a function of the angle through which the rockable arm member 50 is turned from a predetermined reference angular position about the center axis of the pivot shaft 52. As in the detecting assembly 40 of the embodiment described with reference to FIGS. 1 to 3, the predetermined reference angular position of the rockable arm member 50 is assumed to be the angular position which the rockable arm member 50 assumes when the detection roller 44 is received directly on the reference roller 42. The angle through which the rockable arm member 50 is turned from such a reference angular position is indicative of the thickness of a single sheet material P or the total thickness of two or more sheet materials P which may intervene between the lower reference roller 42 and the upper detection roller 44. The signal $S_{w'}$ is supplied to a control system similar to the control system 92 illustrated in FIG. 3 and is also used as has been described with reference to FIG. 4.

As will have been understood from the foregoing description, a sheet feeding apparatus according to the present invention is characterized, inter alia, in that not only a surplus sheet material which has been fed from the stocker unit 10 in addition to a properly fed sheet material but a sheet material improperly fed from the stocker unit and staying in the path of travel of sheet material with no sheet material being driven to travel forwardly can be returned to or toward the stocker unit 10.

A sheet feeding apparatus according to the present invention is further advantageous over a known sheet feeding apparatus. In a prior-art sheet feeding apparatus, it is required that the frictional contact between a sheet material and the peripheral surface of the forward feed roller be firmer than the frictional contact between a sheet material and the peripheral surface of the backward/forward feed roller and additionally the latter be firmer than the frictional contact between sheet materials. In an apparatus according to the present invention, the former requirement is of little importance in that it is simply required that the frictional contact between a sheet material and the peripheral surface of each of the feed rollers be firmer than the frictional contact between sheet materials. The requirement thus alleviated will allow the use of sheet materials of larger numbers of types and natures and offer a wider range of tolerance for the temperatures at which the apparatus will operate properly It is also important that the backward/forward feed roller 20 used in the described embodiment of a sheet feeding apparatus according to the present invention is positively driven for rotation only when a surplus or otherwise improperly fed sheet material is to be returned toward the stocker unit 10 and is allowed to turn by virtue of its frictional engagement with the forward feed roller 18 in the absence of a surplus sheet material fed from the stocker unit 10. The backward/forward feed roller 20 being thus allowed to turn together with the forward feed roller 18 in the absence of a surplus sheet material, there is no sliding friction caused between the forward feed roller 18 and the backward/forward feed roller 20 rotating with the forward feed roller 18. Because of the fact that there is no sliding friction opposing the rotation of the forward feed roller 18, the forward feed roller 18 as well as the backward/forward feed roller 20 is subjected to less wear and abrasion and the sheet material handled by the forward feed roller 18 will produce less paper dust while the sheet material is being passed between the feed rollers 18 and 20. It may also be pointed out that, there being no additional burden which the forward feed roller 20 would otherwise be required to bear, a source of driving power having a reasonable capacity can be used in, for example, the roller drive mechanism 64 including the motor 90 used for the driving of the feed roller assembly 16 in the described embodiment of the present invention.

The drive mechanism 64 for the feed roller assembly 16 is increased particularly when the backward/forward feed roller 20 is driven for rotation in the first direction d driving a surplus sheet material to return toward the stocker unit 10 with the forward feed roller 18 being driven for rotation in the direction of c with no sheet material being driven to travel in the forward direction b. Under these conditions, the sheet material intervening between the feed rollers 18 and 20 is directly contacted by both of the rollers 18 and 20 and, as a consequence, there is produced a buzz from between the feed rollers 18 and 20 being driven to turn in the opposite directions on the sheet material passing between the rollers 18 and 20. A sheet feeding apparatus according to the present invention is thus further advantageous in that such a buzzing sound is not produced when a single properly fed sheet material is being driven to travel forwardly between the rollers 18 and 20 as at step S4 of the routine program described with reference to FIG. 5. When a single properly fed sheet material P is being driven to travel forwardly between the rollers 18 and 20, the backward/forward feed roller 20 is driven for rotation in the second direction d' by its frictional engagement with the forward feed roller 18. Accordingly, there is no buzzing sound produced from between the feed rollers 18 and 20 which are being driven to turn in the same directions on the sheet material intervening between the rollers 18 and 20.

A further advantage of a sheet feeding apparatus according to the present invention results from the use of a dualpurpose detecting assembly which depends for its effect on the movement of a member (such as the reference roller 44 or the detection roller 106) movable responsive to the thickness of a sheet material or the total thickness of two or more sheet materials. Only the thickness of a sheet material being thus of significance in the detection of overlapped feeding of sheet materials, sheet materials of any desired natures and types including transparent, coated, uncoated paper and plastic films, may be used in the apparatus according to the present invention. Where it is desired to use a detecting device responsive to light transmitted through a sheet material of light permeable nature, proper adjustment of the performance characteristics of he device will be required depending on the light transmissivity of the sheet materials to be used.

A sheet feeding apparatus according to the present invention is further advantageous in that any noise that would otherwise be created during shifting between successive cycle of operation will not be produced since the subsequent cycle of operation could not be started before the time interval ($t_f$) longer than the period of time ($t_1$) for which a sheet material is required to travel from the nip between the feed rollers 18 and 20 to the detecting assembly has lapsed after the preceding cycle of operation was terminated.

The sheet feeding means operative to return a surplus or improperly fed sheet material to the stocker unit is implemented by the backward/forward feed roller 20 cooperating the forward feed roller 18 in the described embodiment of the present invention but, if desired, such sheet feeding means may be substituted by a belt and pulley arrangement or any other form of conveying device using an endless belt. While, furthermore, the dual-purpose detecting assembly used in the described embodiment of the present invention is provided in the form of a single unit, such a detecting assembly may be substituted by the combination of a first detector unit responsive to the presence of a surplus sheet material fed together with a properly fed sheet material and a second detector unit responsive to the presence of a sheet material improperly fed with in the absence of a properly fed sheet material.

What is claimed is:

1. A sheet feeding apparatus comprising (a) sheet storage means for storing a stack of sheet materials, (b) forward sheet feeding means having an operative condition capable of feeding a sheet material in a forward direction from said sheet storage means during each cycle of operation of the apparatus, (d) sheet transport means forming a passageway through which a sheet material is to be fed in said forward direction further away from said sheet storage means, (f) detecting means for detecting the presence of a single sheet material or the concurrent presence of two or more sheet materials in said passageway, (e) backward sheet feeding means located in proximity to said forward sheet feeding means and operative to feed to a sheet material in a backward direction toward said sheet storage means, and (f) control means (f/1) for actuating said backward sheet feeding means to feed sheet material in said backward direction toward said sheet storage means if the concurrent presence of two or more sheet materials in said passageway is detected by said detecting means when said forward sheet feeding means is in said operative condition, and (f/2) for actuating said backward sheet feeding means to feed a sheet material in said backward direction toward said sheet storage means if the presence of at least one sheet material in said passageway is detected by said detecting means when said forward sheet feeding means is not in said operative condition.

2. A sheet feeding apparatus as set forth in claim 1, in which said first sheet feeding means comprises a forward feed roller rotatable about a fixed axis and said second sheet feeding means comprises a back/forward feed roller rotatable about a fixed axis parallel with the fixed axis of rotation of said forward feed roller, wherein the apparatus further comprises:

(g) drive means for driving said forward feed roller for rotation in a forward direction in which a sheet material is to be fed in said forward direction away from said sheet storage means and selectively allowing said backward/forward feed roller to rotate in a forward direction with said forward feed roller or driving the backward/forward feed roller for rotation in a backward direction in which a sheet material is to be fed in said backward direction toward said sheet storage means.

3. A sheet feeding apparatus as set forth in claim 2, in which said drive means comprises:

(g/1) a source of driving power, (g/2) first clutch means having a driving member operatively coupled to and driven by said source of driving power and a driven member drivingly coupled to said forward feed roller, and (g/3) second clutch means having a driving member operatively coupled to and driven by said source of driving power and a driven member drivingly coupled to said backward/forward feed roller.

4. A sheet feeding apparatus as set forth in claim 3, in which said driven means further comprises:

(g/4) a flexible coupling member flexibly coupling the driven member of said second clutch means to said backward/forward feed roller.

5. A sheet feeding apparatus as set forth in claim 1, in which said detecting means consists of thickness detecting means responsive to the thickness of a single sheet material or the total thickness of a plurality of sheet materials fed in said forward direction from said sheet storage means for producing a thickness signal variable with the detected thickness of the sheet material of materials.

6. A sheet feeding apparatus as set forth in claim 5, in which said thickness detecting means comprises:

(c/1) a reference roller rotatable about a fixed axis, (c/2) a detection roller rotatable about an axis parallel with and movable with respect to the fixed axis of rotation of said reference roller, said reference roller and said detection roller being located downstream of said forward sheet feeding means with respect to the sheet transporting direction and forming therebetween a nip located in the path of a sheet material fed from said sheet storage means by said first sheet feeding means, (c/3) a rockable member carrying said detection roller and rockable about an axis fixed with respect to the fixed axis of rotation of said reference roller, said rockable member having about the axis of rocking motion thereof a predetermined reference angular position with said detection roller held in direct contact with said reference roller, and (c/4) sensing means operative to detect the angular movement of said rockable member from said reference angular position and produce as said thickness signal a signal variable with the detected angular position of the rockable member.

7. A sheet feeding apparatus as set forth in claim 6, in which said sensing means comprises a rotary potentiometer having (c/4/1) a resistor element fixed with respect to and arcuately curved about the axis of rocking motion of said rockable member, and (c/4/2) a contact element rotatable about the axis of rocking motion of said rockable member and slidable on said resistor element.

8. A sheet feeding apparatus as set forth in claim 6, in which said sensing means comprises (c/4/1) light emitting means fixed with respect to the fixed axis of rotation of said reference roller and operative to emit a collimated beam of light, and (c/4/2) light receiving means fixed with respect to said light receiving means and operative to produce an electrical signal variable in magnitude with the quantity of light incident thereon, (c/4/3) said light emitting means and said light receiving means being spaced apart from and aligned with each other so that said rockable member has a portion movable between the light emitting and receiving means in a direction substantially perpendicular into the direction in which the light emitting and receiving means are aligned with each other whereby the beam of light directed from said light emitting means toward said light receiving means is intercepted in a continuously varying proportion by said portion of the rockable member as the rockable member turns about the axis of rocking motion thereof with respect to the light emitting and receiving means.

9. A sheet feeding apparatus as set forth in claim 5, in which said thickness detecting means comprises:

(c/1) a reference member having a fixed horizontal surface, (c/2) a detection roller rotatable about an axis parallel with and vertically movable with respect to the fixed axis of rotation of said reference roller, said reference member and said detection roller being located downstream of said forward sheet feeding means with respect to the sheet transporting direction and capable of forming therebetween a clearance located in the path of a sheet material fed from said sheet storage means by said first sheet feeding means, said detection roller having a predetermined reference position directly held in contact with said reference member, and (c/3) sensing means operative to detect the vertical movement of said detection roller from said reference angular position and produce as said thickness signal a signal variable with the detected vertical position of the detection roller with respect to the fixed horizontal surface of said reference member.

10. A sheet feeding apparatus as set forth in claim 9, in which said sensing means comprises:

(c/3/1) a support member carrying said detection roller and vertically movable with respect to the fixed horizontal surface of said reference member, and (c/3/2) a linear potentiometer having a vertically elongated resistor element fixed with respect to said reference member, and a contact element vertically movable with said support member and slidable on said resistor element.

11. A sheet feeding apparatus comprising (a) sheet storage means for storing a stack of sheet materials, (b) first sheet feeding means means having an operative condition capable of feeding a sheet material in a forward direction away from said sheet storage means during each cycle of operation of the apparatus, (c) detecting means operative to detect the presence of a single sheet material properly fed in said forward direction away from said sheet storage means or of a plurality of sheet materials which may be concurrently fed in said forward direction from said sheet storage means and which include a single properly fed sheet material to be further moved away from said sheet storage means by said first sheet feeding means and at least one improperly fed sheet material to be moved in a backward direction toward said sheet storage means, (d) second sheet feeding means means having an operative condition capable of feeding said improperly fed sheet material in said backward direction toward said sheet storage means when the presence of the improperly fed sheet material is detected by said detecting means, and (e) third sheet feeding means operative to further feed said properly fed sheet material in said forward direction away from said sheet storage means, (f) said detecting means being further operative to detect the presence of at least one improperly fed sheet material which has been fed in said forward direction from said sheet storage means by said first sheet feeding means and which has not been further fed away from said sheet storage means by said third sheet feeding means when said first sheet feeding means is de-activated out of the operative condition thereof.

12. A sheet feeding apparatus as set forth in claim 11, further comprising a control system which comprises (g/1) signal generating means operative to produce a first signal for activating said first sheet feeding means into the operative condition thereof, and (g/2) means cooperative with said detecting means for producing a second signal indicative of the presence of a single sheet material fed in said forward direction from said sheet storage means or a third signal indicative of the presence of a plurality of sheet materials improperly fed sheet material which has been fed in said forward direction from said sheet storage means concurrently with and in addition to said single sheet material, (g/3) said second sheet feeding means being responsive to said first, second and third signals for feeding said improperly fed sheet material in said backward direction toward said sheet storage means in the concurrent presence of the first and third signals, feeding said single sheet material in said backward direction toward said sheet storage means in the absence of the first signal and concurrent presence of said second signal, and feeding said improperly fed sheet material in said backward direction toward said sheet storage means in the absence of the first signal and concurrent presence of said second or third signal.

13. A sheet feeding apparatus as set forth in claim 11, in which said first sheet feeding means comprises a forward feed roller rotatable about a fixed axis and said second sheet feeding means comprises a backward/forward feed roller rotatable about a fixed axis parallel with the fixed axis of rotation of said forward feed roller, wherein the apparatus further comprises (g) drive means for driving said forward feed roller for rotation in a forward direction in which a sheet material is to be fed in said forward direction away from said sheet storage means and selectively allowing said backward/forward feed roller to rotate in a forward direction with said forward feed roller or driving the backward/forward feed roller for rotation in a backward direction in which a sheet material is to be fed in said backward direction toward said sheet storage means.

14. A sheet feeding apparatus as set forth in claim 13, in which said drive means comprise (g/1) a source of driving power, (g/2) first clutch means having a driving member operatively coupled to and driven by said source of driving power and a driven member drivingly coupled to said forward feed roller, and (g/3) second clutch means having a driving member operatively coupled to and driven by said source of driving power and a driven member drivingly coupled to said backward/forward feed roller.

15. A sheet feeding apparatus as set forth in claim 14, in which said driven means further comprises (g/4) a flexible coupling member flexibly coupling the driven member of said second clutch means to said backward/forward feed roller.

16. A sheet feeding apparatus as set forth in claim 11, in which said detecting means consists of thickness detecting means responsive to the thickness of a single sheet material or the total thickness of a plurality of sheet materials fed in said forward direction from said sheet storage means for producing a thickness signal variable with the detected thickness of the sheet material or materials.

17. A sheet feeding apparatus as set forth in claim 16, in which said thickness detecting means comprises (c/1) a reference roller rotatable about a fixed axis, (c/2) a detection roller rotatable about an axis parallel with and movable with respect to the fixed axis of rotation of said reference roller, said reference roller and said detection roller being located intermediate between said first sheet feeding means and said third sheet feeding means and forming therebetween a nip located in the path of a sheet material fed from said sheet storage means by said first sheet feeding means, (c/3) a rockable member carrying said detection roller and rockable about an axis fixed with respect to the fixed axis of rotation of said reference roller, said rockable member having about the axis of rocking motion thereof a predetermined reference angular position with said detection roller held in direct contact with said reference roller, and (c/4) sensing means operative to detect the angular movement of said rockable member from said reference angular position and produce as said thickness signal a signal variable with the detected angular position of the rockable member.

18. A sheet feeding apparatus as set forth in claim 17, in which said sensing means comprises a rotary potentiometer having (c/4/1) a resistor element fixed with respect to and arcuately curved about the axis of rocking motion of said rockable member, and (c/4/2) a contact element rotatable about the axis of rocking motion of said rockable member and slidable on said resistor element.

19. A sheet feeding apparatus as set forth in claim 17, in which said sensing means comprises (c/4/1) light emitting means fixed with respect to the fixed axis of rotation of said reference roller and operative to emit a collimated beam of light, and (c/4/2) light receiving means fixed with respect to said light receiving means and operative to produce an electrical signal variable in magnitude with the quantity of light incident thereof, (c/4/3) said light emitting means and said light receiving means being spaced apart from and aligned with each other so that said rockable member has a portion movable between the light emitting and receiving means in a direction substantially perpendicular to the direction in which the light emitting and receiving means are aligned with each other whereby the beam of light directed from said light emitting means toward said light receiving means is intercepted in a continuously varying proportion by said portion of the rockable member as the rockable member turns about the axis of rocking motion thereof with respect to the light emitting and receiving means.

20. A sheet feeding apparatus as set forth in claim 17, in which said sensing means comprises (c/4/1) light emitting means fixed with respect to the fixed axis of rotation of said reference roller and operative to emit light, and (c/4/2) light receiving means fixed with respect to said light receiving means, (c/4/3) said light emitting means and said light receiving means being spaced apart from each other so that said rockable member has a portion movable between the light emitting and receiving means in a direction substantially perpendicular to the direction in which the light emitting and receiving means are spaced apart from each other, (c/4/4) said rockable member having in said portion thereof an aperture which is open toward both of the light emitting and receiving means so that the light emitted from said light emitting means and allowed to pass through said aperture is incident on said light receiving means and forms a bright spot on the light receiving means, the location of the bright spot produced on the light receiving means being variable with the angular position of said rockable member with respect to the light emitting and receiving means, (c/4/5) said light receiving means being operative to produce an electrical signal variable with the location of a bright spot produced thereon through said aperture.

21. A sheet feeding apparatus as set forth in claim 16, in which said thickness detecting means comprises (c/1) a reference member having a fixed horizontal surface, (c/2) a detection roller rotatable about an axis parallel with and vertically movable with respect to the fixed axis of rotation of said reference roller, said reference member and said detection roller being located intermediate between said first sheet feeding means and said third sheet feeding means and capable of forming therebetween a clearance located in the path of a sheet material fed from said sheet storage means by said first sheet feeding means, said detection roller having a predetermined reference position directly held in contact with said reference member, and (c/3) sensing means operative to detect the vertical movement of said detection roller from said reference angular position and produce as said thickness signal a signal variable with the detected vertical position of the detection roller with respect to the fixed horizontal surface of said reference member.

22. A sheet feeding apparatus as set forth in claim 21, in which said sensing means comprises (c/3/1) a support member carrying said detection roller and vertically movable with respect to the fixed horizontal surface of said reference member, and (c/3/2) a linear potentiometer having a vertically elongated resistor element fixed with respect to said reference member, and a contact element vertically movable with said support member and slidable on said resistor element.

23. A sheet feeding apparatus as set forth in claim 22, in which said sensing means further comprises (c/3/3) a flexible resistance reducing film strip placed between said detection roller and the fixed horizontal surface of said reference member for reducing the friction between the sheet material travelling on the fixed horizontal surface of the reference member and the detection roller rolling on the resistance reducing film strip.

* * * * *